US010495407B1

(12) United States Patent
Shelton et al.

(10) Patent No.: US 10,495,407 B1
(45) Date of Patent: Dec. 3, 2019

(54) PANEL ATTACHABLE TO A FIREARM

(71) Applicant: RAILSCALES LLC, Claremore, OK (US)

(72) Inventors: Derek Hunter Shelton, Claremore, OK (US); Brent Taylor McGuire, Depew, OK (US)

(73) Assignee: RAILSCALES LLC, Claremore, OK (US)

( * ) Notice: Subject to any disclaimer, the term of this patent is extended or adjusted under 35 U.S.C. 154(b) by 0 days.

(21) Appl. No.: 16/180,700

(22) Filed: Nov. 5, 2018

(51) Int. Cl.
*F41C 23/16* (2006.01)

(52) U.S. Cl.
CPC ..... *F41C 23/16* (2013.01)

(58) Field of Classification Search
CPC ..... F41C 23/16
USPC ..... 42/71.01
See application file for complete search history.

(56) References Cited

U.S. PATENT DOCUMENTS 7,987,623 B1 * 8/2011 Moody ..... F41A 23/08 42/71.01
8,341,866 B1 * 1/2013 Gaddini ..... F41G 11/003 42/71.01
8,393,104 B1 * 3/2013 Moody ..... F41C 23/14 42/71.01
9,115,955 B2 * 8/2015 Barnhart ..... F41C 23/16
9,239,209 B2 * 1/2016 Mayberry ..... F41G 11/005
9,395,152 B2 * 7/2016 Barnhart ..... F41C 23/16
D774,620 S * 12/2016 Shelton ..... D22/108
D790,653 S * 6/2017 Shelton ..... D22/108
9,696,112 B2 * 7/2017 Gottzmann ..... F41G 11/003
D798,410 S * 9/2017 Shelton ..... D22/108
9,964,380 B1 * 5/2018 Oglesby ..... F41C 23/16
9,989,328 B2 * 6/2018 Ding ..... F41A 35/02
D842,420 S * 3/2019 Liu ..... D22/108
10,260,841 B2 * 4/2019 Kincel ..... F41G 11/003
2003/0106252 A1 * 6/2003 Hines ..... F41A 35/02 42/90
2009/0100734 A1 * 4/2009 Swan ..... F41C 23/16 42/71.01
2009/0241397 A1 * 10/2009 Fitzpatrick ..... F41C 23/16 42/90
2010/0205795 A1 * 8/2010 Moody ..... F41A 23/08 29/428
2011/0107642 A1 * 5/2011 Godard ..... F41C 23/10 42/71.01
2012/0085013 A1 * 4/2012 Cahill ..... F41A 35/02 42/96
2012/0297970 A1 * 11/2012 Langevin ..... F41C 23/16 89/125
2013/0326925 A1 * 12/2013 Power ..... F41C 23/16 42/71.01
2014/0325888 A1 * 11/2014 Barnhart ..... F41C 23/16 42/71.01

(Continued)

*Primary Examiner* — Joshua E Freeman
(74) *Attorney, Agent, or Firm* — Eversheds Sutherland (US) LLP

(57) ABSTRACT

A panel attachable to a firearm rail including an elongated body with a top side, an opposed bottom side, a front end, and a rear end. The front end and the rear end each includes at least one aperture extending through the top side to the opposed bottom side of the elongated body. The panel also includes a gripped surface on the top side of the elongated body and a slot extending through the top side to the opposed bottom side. The slot is configured to receive a firearm accessory.

20 Claims, 11 Drawing Sheets

(56) References Cited

U.S. PATENT DOCUMENTS

| | | | | |
|---|---|---|---|---|
| 2015/0159978 | A1* | 6/2015 | Barnhart | F41C 23/16<br>40/725 |
| 2015/0285583 | A1* | 10/2015 | Mayberry | F41G 11/005<br>42/71.01 |
| 2017/0205183 | A1* | 7/2017 | Ding | F41A 35/02 |
| 2017/0307328 | A1* | 10/2017 | Shelton | F41C 27/00 |
| 2018/0112952 | A1* | 4/2018 | Kincel | F41G 11/003 |

* cited by examiner

PANEL ATTACHABLE TO A FIREARM

FIELD OF THE DISCLOSURE

The present application relates generally to panels attachable to a firearm rail system, and more particularly, to panels comprising one or more slots for attaching an accessory to the firearm rail system therethrough.

BACKGROUND

Modern firearm rail systems are commonly used for attaching various accessories around the barrel of a rifle, typically an AR-15® or another similar type rifle. Accessories capable of mounting onto the rail system include scopes, flashlights, knives, slings, or grips. Each accessory can be a handy tool for a firearm enthusiast's arsenal. For example, gripping panels come in many forms to provide a sturdy surface around the rail system for the user.

BRIEF DESCRIPTION OF THE DRAWINGS

Referring now to the drawings, which are meant to be exemplary and not limiting, and wherein like elements are numbered alike. The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

The disclosure is directed to a panel attachable to a firearm rail system. Example firearm rail systems include Picatinny, M-Lok, and KeyMod. Any suitable firearm rail system may be used. An accessory may be attached to the firearm rail system through a slot (i.e., a hole) in the panel. In this manner, the panel may provide a textured surface surround the firearm accessory. The slot may be configured to receive a firearm accessory therethrough. In this manner, the firearm accessory may be attached to the firearm rail system through the slot in the panel. As a result, the slot may surround the firearm accessory. In some instances, the firearm accessory may comprise a hand stop, a flashlight, a laser, a vertical grip, a grenade launcher, or other similar accessory configured to fit through the slot onto the firearm rail system. Any suitable firearm accessory capable of being attached to the rail system may be used. In this manner, the size, shape, and configuration of the slot may correspond to the size, shape, and configuration of the firearm accessory. The panel provides for a gripped surface surrounding the entirety of firearm accessory. One benefit of the panel may be the promotion of further customizing firearm rail systems to suit individual user needs by providing a textured surface for the firearm rail system as well as a slot for mounting accessories therethrough.

Figure 1:
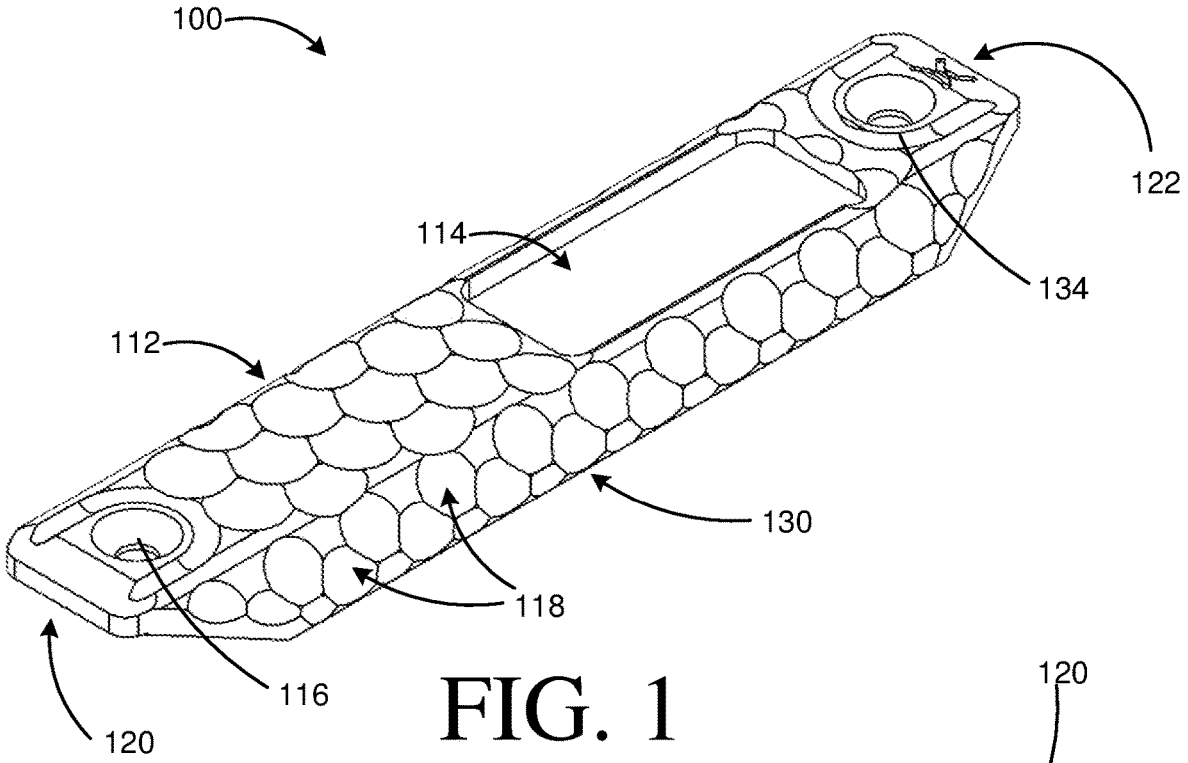
FIG. 1 is a perspective view of the panel according to one or more embodiments of the disclosure.
Figure 2:
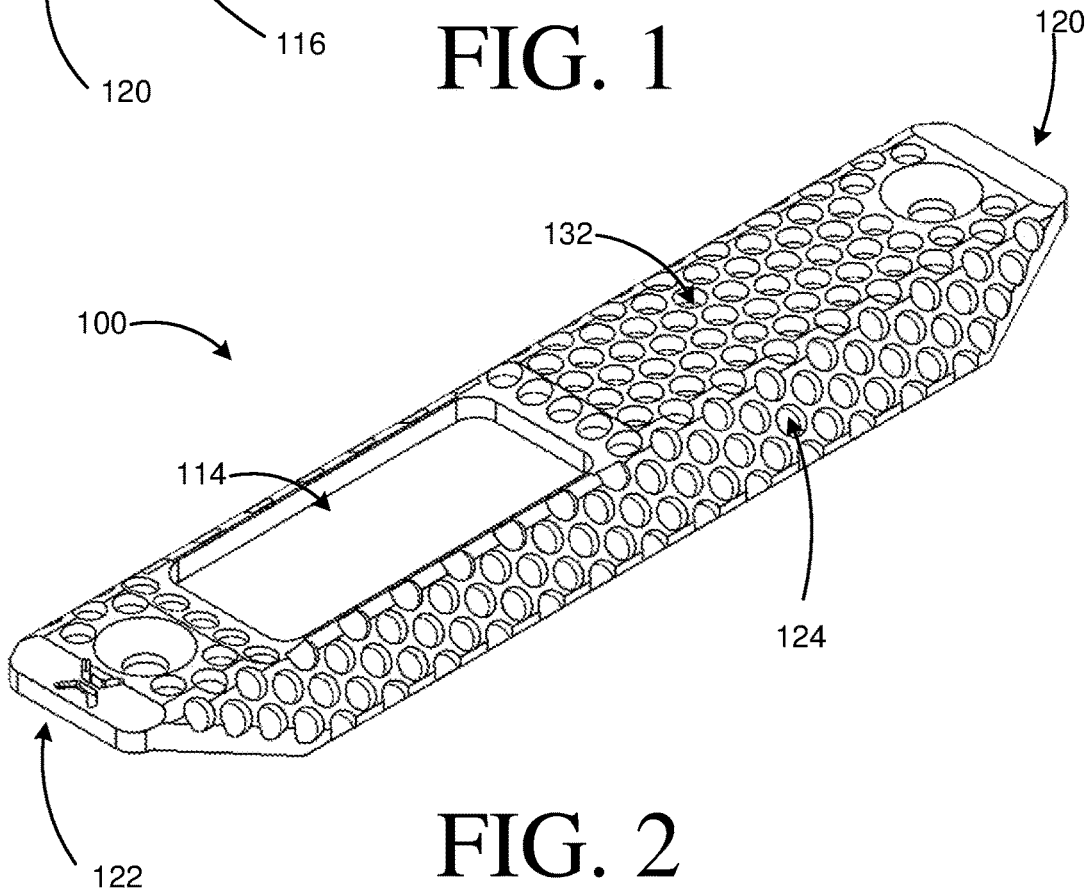
FIG. 2 is a perspective view of the panel according to one or more embodiments of the disclosure.
Figure 5:
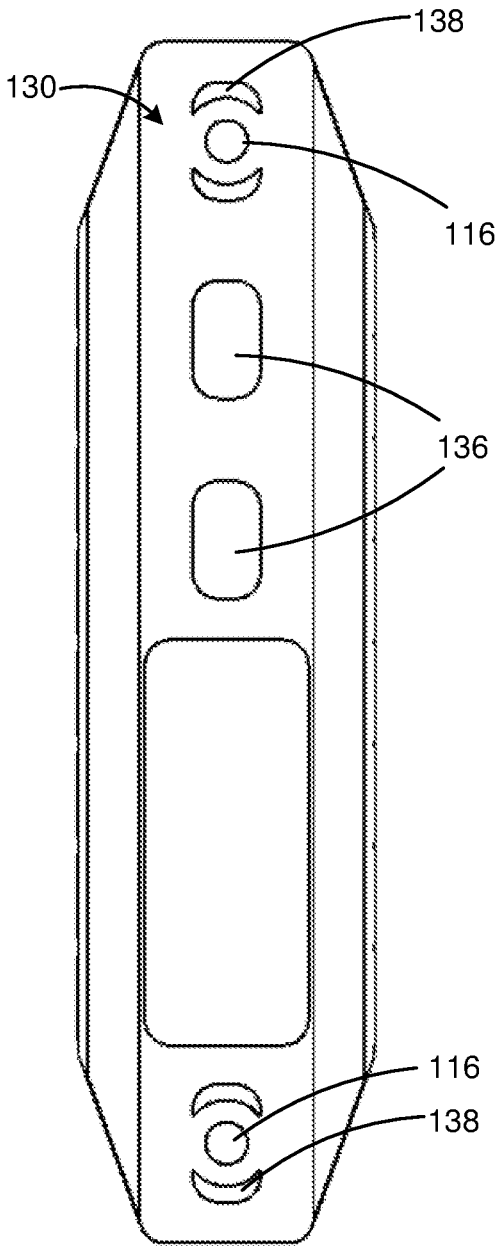
FIG. 5 is a bottom view of the panel according to one or more embodiments of the disclosure.
Figure 6:
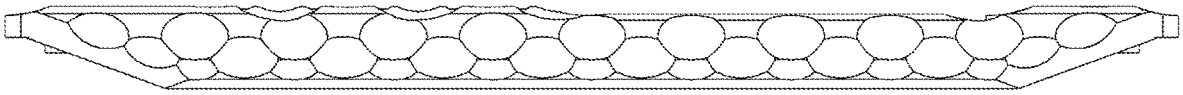
FIG. 6 is a side view of the panel according to one or more embodiments of the disclosure.
Figure 7:
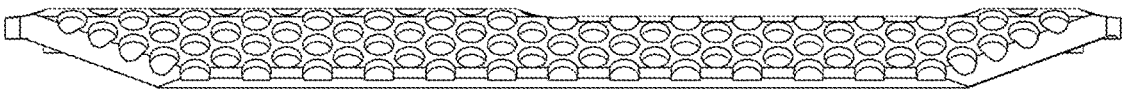
FIG. 7 is a side view of the panel according to one or more embodiments of the disclosure.
Figure 12:
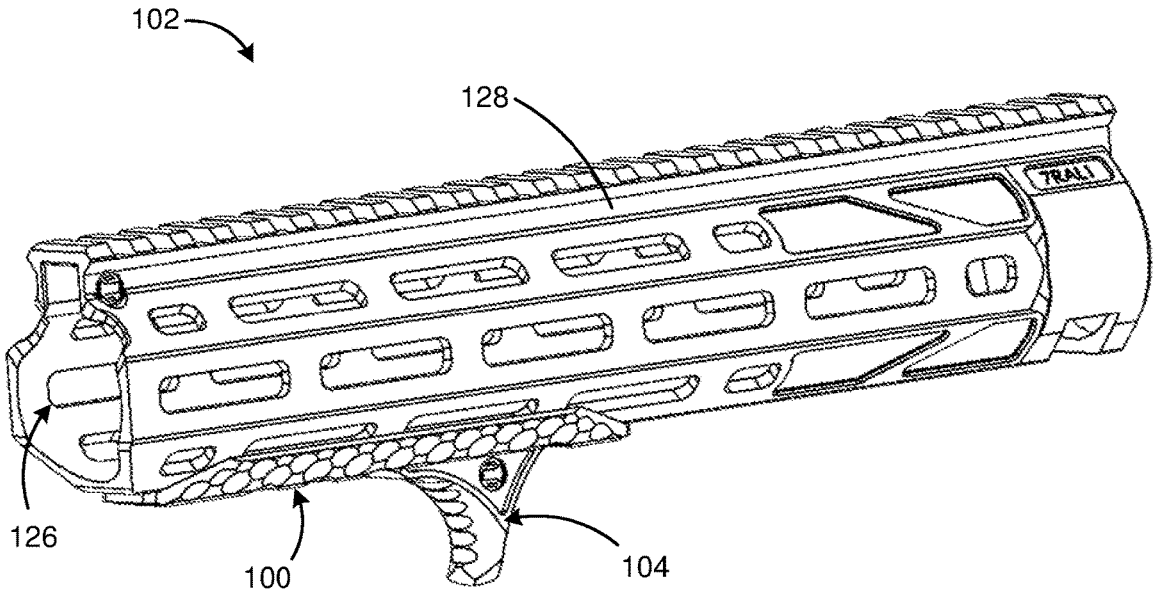
FIG. 12 is perspective view of a panel coupled to a rail system according to one or more embodiments of the disclosure.
Figure 14:
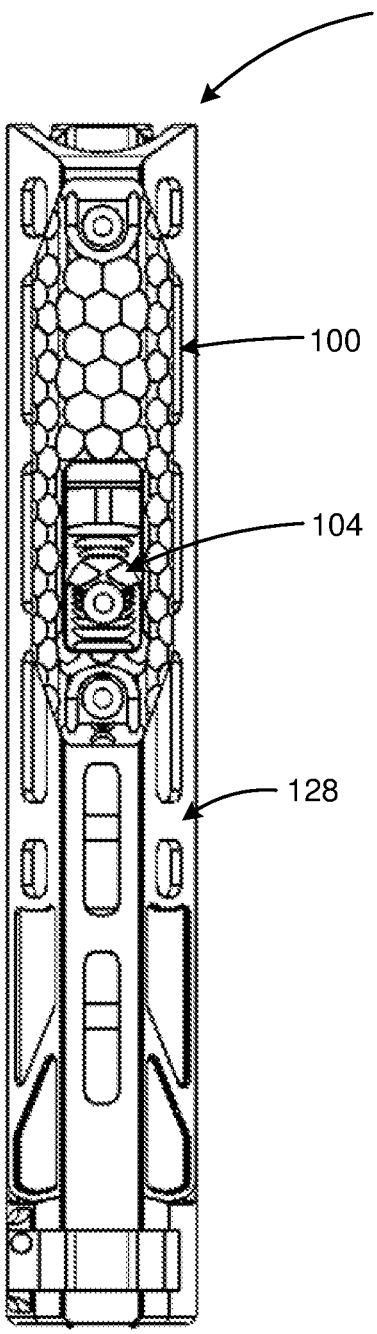
FIG. 14 is bottom view of the panel coupled to the rail system according to one or more embodiments of the disclosure.
Figure 15:
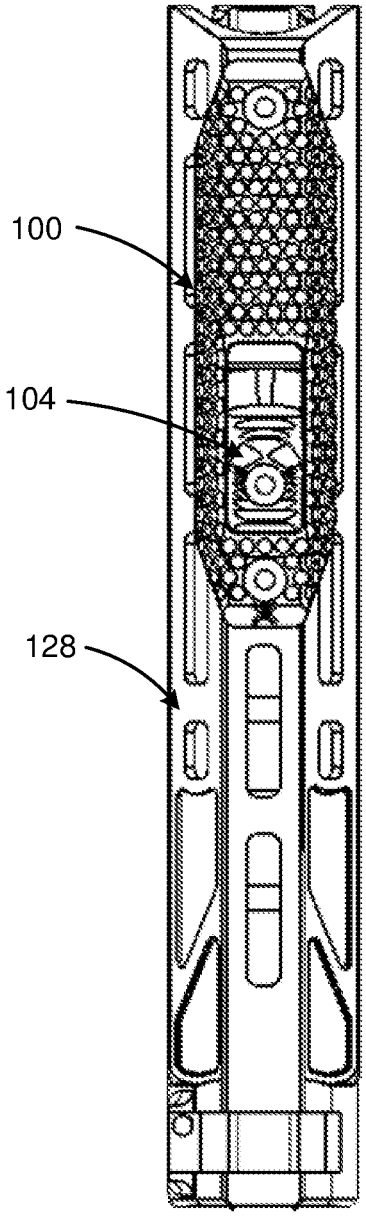
FIG. 15 is bottom view of the panel coupled to the rail system according to one or more embodiments of the disclosure.

In some embodiments, as depicted in FIGS. 1 and 2, a panel 100 is provided. The panel 100 may include a top side 132, an opposed bottom side 130 (e.g., as shown in FIG. 5), a front end 120, and a rear end 122. The opposed bottom side 130 is opposite the top side 132. The front end 120 is opposite the rear end 122. Each end or side may be configured for several purposes, including temporarily or permanently attaching the panel 100 to a firearm rail 128 (as depicted in FIG. 12), receiving a firearm accessory 104 (as depicted in FIG. 12) through a slot 114, and/or providing grip to a user holding the firearm rail 128. As noted, the panel 100 is configured to mount to the firearm rail 128. For example, the opposed bottom side 130 may be disposed on the surface of the firearm rail 128. The panel 100 enables a user to adjust the gripping surface as well as be adapted to fit other firearm rail system assembly 102 accessories, such as a hand stop. One benefit of the panel, as discussed herein, may include efficiently using the rail by providing a textured surface for the firearm rail and simultaneously allow firearm accessories to be mounted through the panel via a slot 114. In this manner, the slot 114 may abut (or be disposed against) all sides of the firearm accessory, as depicted in FIGS. 14 and 15. For example, the top side of 132 of the panel 100 may provide a gripping surface that is disposed around and abuts all sides of the firearm accessory. In this manner, there is no gap around the firearm accessory in the gripping surface. That is, the gripping surface provided by the top side 132 of the panel 100 is disposed around and against all sides of the firearm accessory.

In some embodiments, as depicted in FIGS. 1 and 2, the elongated body 112 includes a slot 114 extending through the top side 132 configured to accept a firearm accessory 104. For example, the firearm accessory 104 may have a rectangular mounting surface 106 and the slot 114 may be a complementary shape. The firearm accessory 104 may a variety of different tools and/or attachments configured to mount through the slot 114 onto the firearm rail system 128. The firearm accessory 104 may be configured to complement the slot 114 shape. For example, the slot 114 may be rectangular. In some instances, the slot 114 may be adapted to engage a firearm accessory 104 via fastener or receiving apertures. In other instances, a rounded-edge rectangular orifice may define the slot 114. The slot 114 may be defined by another shape, such as sharp-edge rectangle, circle, square, or some other shape. In some instances, the slot 114 may be located on the top side 132. In other instances, the slot 114 may be located on another side, such as the front end 120 or the rear end 122.

Figure 3:
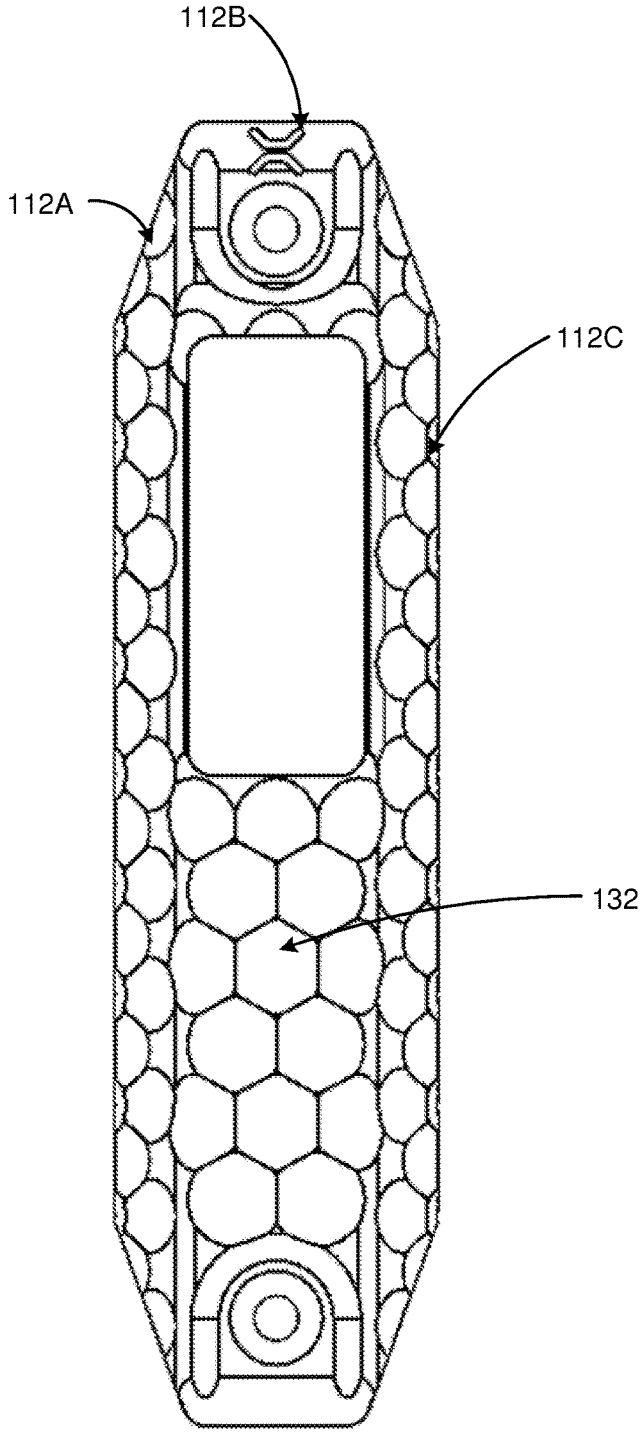
FIG. 3 is a top view of the panel according to one or more embodiments of the disclosure.
Figure 4:
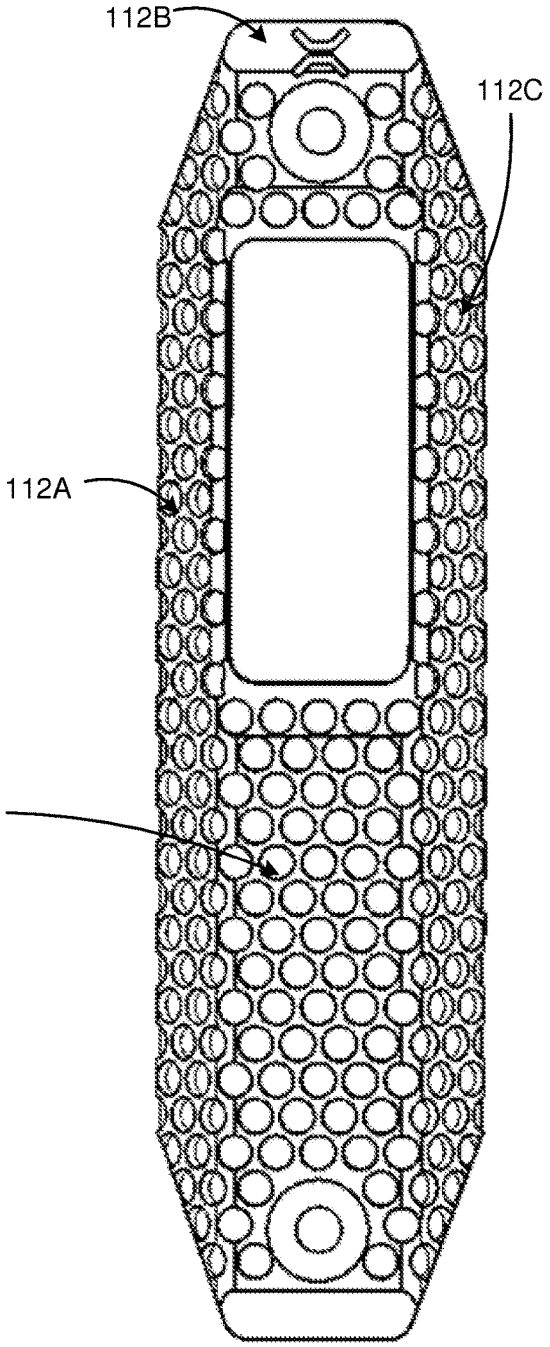
FIG. 4 is a top view of the panel according to one or more embodiments of the disclosure.

As shown in FIGS. 2-4, the top side 132 surface adjacent to the slot 114 may slope towards the slot 114. For example, the rectangular surface 112B (as depicted in FIGS. 3 and 4) on the top side 132 may be substantially flat and within a half inch of the slot 114, the rectangular surface 112B may slope towards the slot 114. In other instances, the rectangular surface 112B may not slope towards the slot 114. In yet other instances, the rectangular surface 112B may slope towards the slot 114 at some other angle and/or distance. Any surface on which the slot 114 may be located may or may not slope towards the slot 114.

In some embodiments, as depicted in FIGS. 3 and 4, the panel 100 includes an elongated body 112. The elongated body 112 may include at least three surfaces, including a rectangular surface 112B and two trapezoidal surfaces 112A/112C. In other embodiments, the elongated body 112 may have different shaped surfaces, including triangular, circular, pyramidal, or some other shape or combination of shapes. In some instances, the elongated body 112 may include less than three or more than three surfaces. The surfaces may angled in different directions. For example, the rectangular surface 112B may be parallel with at least one aperture 116 through the elongated body 112. The two trapezoidal surfaces 112A/112C may be angled towards the opposed bottom side 130 extending from the rectangular surface 112B. For example, the two trapezoidal surfaces 112A/112C may be angled at a 30 degree angle from the rectangular surface 112B. In other instances, the trapezoidal surfaces 112A/112C may be angled between 0 degrees to 29 degrees or 31 degrees to 359 degrees from the top side 132 of the rectangular surface 112B. In some embodiments, the rectangular surface 112B and the trapezoidal surfaces 112A/112C may include a substantially flat surface. For example, at the front end 120 and the rear end 122, the rectangular surface 112B may be sloped towards the opposed bottom side 130. For example, the rectangular surface 112B may be flat and parallel with the at least one aperture 116. In some instances, the elongated body 112 may be 4.7 inches long, 1.165 inches wide, and have a thickness of 0.125 inches. In other instances, the elongated body 112 may be more or less than 4.7 inches long, more or less than 1.165 inches wide, and have a thickness more or less than 0.125 inches.

In some embodiments, as shown in FIGS. 1-4, the elongated body 112 includes a gripped surface. For example, the gripped surface may be a series of cavities 118 or a plurality of bores 124. The series of cavities 118 may be semi-circular cavities. In other instances, the series of cavities 118 may be some other shape, including triangular, square, rectangular, or another shape. In some instances, the series of cavities 118 may overlap and be continuous across the entire top side 132 of the elongated body 112. In other instances, the series of cavities 118 may be separated and discontinuous in pattern. The elongated body 112 may include the plurality of bores 124. In some instances, the plurality of bores 124 may be circular. For example, the plurality of bores 124 may be cylindrical apertures. In other instances, the plurality of bores may be a different shape, such as pyramidal, spherical, rectangular, or cubical. One benefit of the gripped surface may include creating a no slip surface for a user about a firearm rail 128.

In some embodiments, as depicted in FIGS. 1-4, the elongated body 112 has at least one aperture 116 extending through the top side 132 of the elongated body 112. The at least one aperture 116 may be configured to receive a fastener to secure the elongated body 112 to a firearm rail 128. In some embodiments, the at least one aperture 116 is two apertures located at a front end 120 and a rear end 122 of the elongated body 112. In some instances, the at least one aperture 116 may be located anywhere along the elongated body 112. For example, the at least one aperture 116 may be in the middle of the elongated body 112. In some instances, the at least one aperture 116 may be three or more apertures. In some instances, the at least one aperture 116 may be circular. In other instances, the at least one aperture 116 may be a variety of other shapes, including rectangular, oval, square, or another shape. In some embodiments, as in FIG. 1, the at least one aperture 116 may have a discontinuous channel 134 adjacent to the at least one aperture 116. The elongated body 112 may also slope adjacent to the at least one aperture 116. In other instances, the elongated body 112 may be flat around the at least one aperture 116.

In some embodiments, as depicted in FIG. 5, the panel 100 includes protrusions configured to engage the firearm rail 128. For example, the panel 100 may include a series of protrusions 136 protruding from the opposed bottom side 130. In some instances, the series of protrusions 136 may be parallel with one another. In other instances, the series of protrusions 136 may be located on different surfaces of the panel 100. The series of protrusions 136 may be shaped to fit within the firearm rail's 128 plurality of apertures 126. For example, the series of protrusions 136 may be rectangular with rounded edges. In some instances, the series of protrusions 136 may be some other shape, such as triangular, circular, square, or some other shape. In some embodiments, as shown in FIG. 5, the panel 100 protrusions includes a set of crescent protrusions 138 adjacent to the at least one aperture 116 on the opposed bottom side 130. In other instances, the set of crescent protrusions 138 may be located on a different panel 100 surface, such as the top side 132. In other embodiments, the panel 100 may not include any protrusions.

Figure 8:
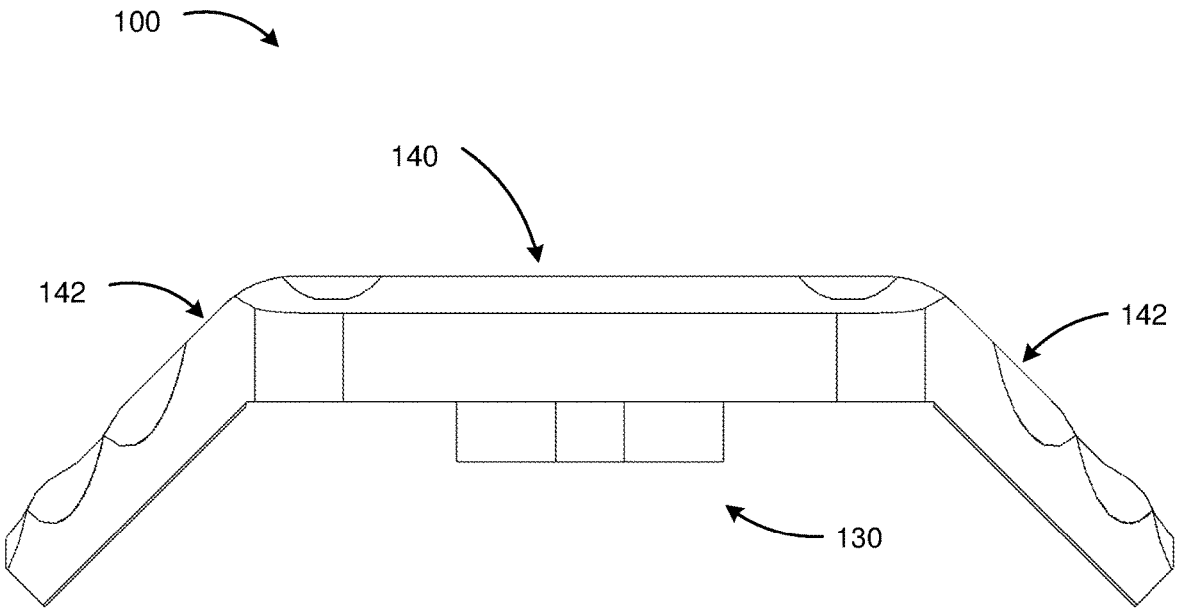
FIG. 8 is a front view of the panel according to one or more embodiments of the disclosure.
Figure 9:
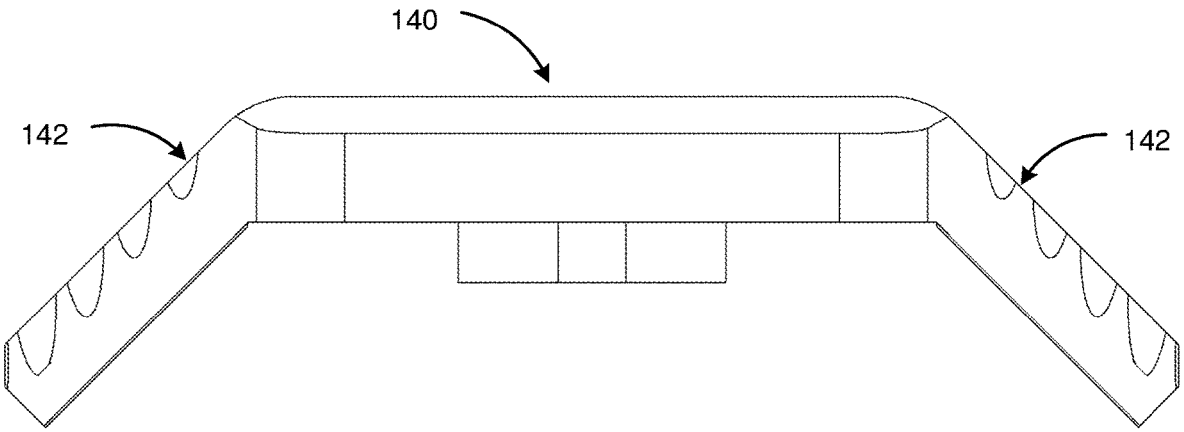
FIG. 9 is a front view of the panel according to one or more embodiments of the disclosure.
Figure 10:
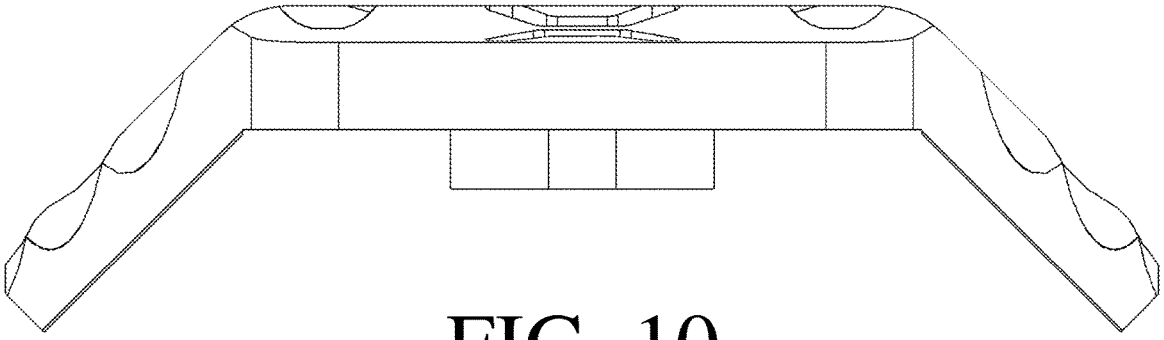
FIG. 10 is a rear view of the panel according to one or more embodiments of the disclosure.
Figure 11:
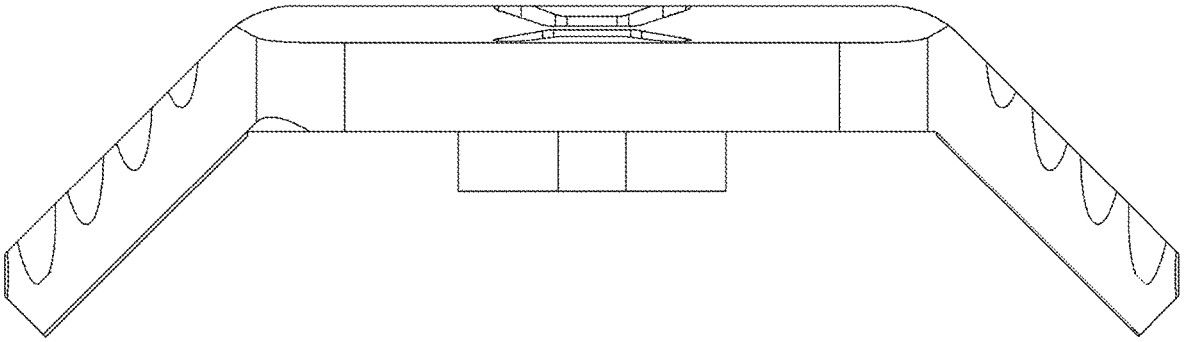
FIG. 11 is a rear view of the panel according to one or more embodiments of the disclosure.

In some embodiments, as shown in FIGS. 8-9, the panel 100 includes a middle portion 140 and a set of side portions 142. For example, the middle portion 140 may be parallel and/or on the same plane with the slot 114 (e.g., as shown in FIG. 1). In some instances, the middle portion 140 may be a flat surface. In other instances, the middle portion 140 may be textured and/or angled in various directions about the surface of the panel 100. The middle portion 140 may define a rectangular surface. In other instances, the middle portion 140 may define another geometric shape, such as circular or triangular. From the middle portion 140, a set of side portions 142 may be angled away from the middle portion 140. For example, the set of side portions 142 may be angled toward the bottom side 130 of the panel 100. The middle portion 140 and the set of side portions 142 may be configured to wrap a portion of a firearm rail (e.g., as shown in FIG. 12). In some instances, the set of side portions 142 may define a trapezoidal surface extending from the middle portion 140. In other instances, the set of side portions 142 may define another geometric shape, such as rectangular, square, or triangular.

Figure 13:
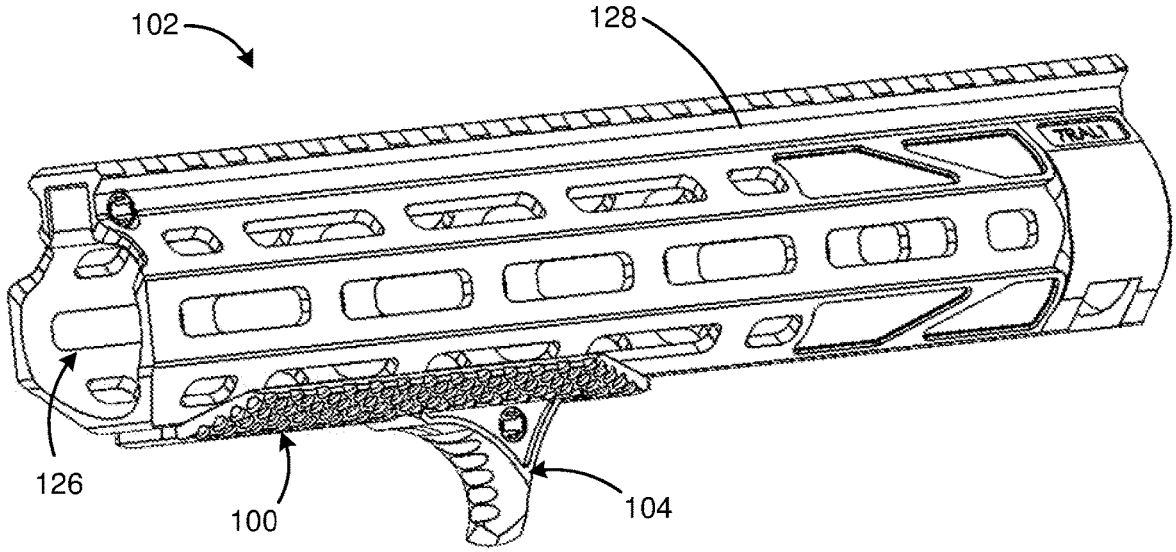
FIG. 13 is perspective view of the panel coupled to the rail system according to one or more embodiments of the disclosure.

In some embodiments, as depicted in FIGS. 12-15, a firearm rail system assembly 102 is provided. The firearm rail system assembly 102 may include a panel 100 and a complementary firearm accessory 104 attached to a firearm rail 128. In some instances, the panel 100 and the firearm accessory 104 may attach to the firearm rail 128 via a plurality of apertures 126 along the exterior of the firearm rail 128. In other instances, the panel 100 and the firearm accessory 104 may attach to another structure of the firearm rail 128, such as a series of slots or a solid surface. As shown in FIGS. 12 and 13, the firearm rail 128 has a plurality of apertures 126 extending sequentially end to end along the firearm rail 128. In some instances, the plurality of apertures 126 may be sequential and continuous in pattern. In other instances, the plurality of apertures 126 may be discontinuous. The plurality of apertures 126 may be the same shape, such as rectangular. In other embodiments, the plurality of apertures 126 may be different shapes, such as circular, triangular, square, oval, or another shape. As depicted in FIGS. 12-15, the firearm accessory 104 and panel 100 mount to one side of the firearm rail 128. In some instances, the firearm accessory 104 and panel 100 mount to a different side, such as the top side, bottom side, or lateral side. In some instances, the firearm accessory 104 and panel 100 mount closer to the receiver of the firearm (not shown). In other instances, the firearm accessory 104 and panel 100 mount away from the receiver. As discussed later and seen in FIGS. 14 and 15, the panel 100 may mount onto the firearm rail 128 with the rear end 122 of the panel 100 closer to the receiver of the firearm. In other instances, the panel 100 may mount onto the firearm rail 128 with the front end 122 of the panel 100 closer to the receiver of the firearm. The firearm rail 128 may be manufactured by, and the panel may fit, a PWS Mod 1/Mod 2 rail, BOOTLEG INC. rail, BCM KMR/MMR, AAC Teardrop, GEISSELE 4 sided rail, DANIEL DEFENSE Slim rail, MIDWEST SSK/SSM, Midwest G3KL/G3ML, CMMG Rails Keymod/M-LOK, DAKOTA TACTICAL HK Series Keymod/M-LOK, VLTOR FREEDOM rail, PARKER MOUNTAIN MACHINE SCAR rail, KNS PRECISION, INC. Bren 805 rail, HK PARTS HK rail, NOVESKE NSR, NOVESKE NHR, NOVESKE NSRM, SMOS ARMS, or KAC URX 4 Keymod/M-LOK.

Figure 16:
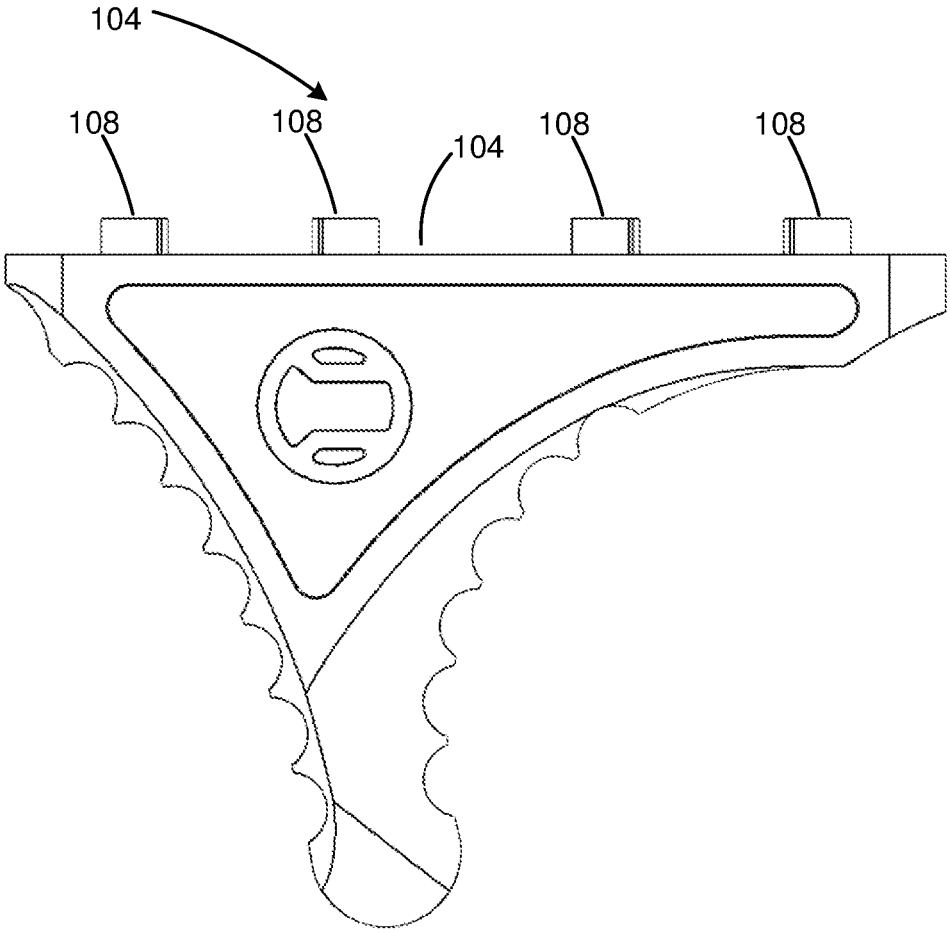
FIG. 16 is a side view of a hand stop according to one or more embodiments of the disclosure.

In some embodiments, as depicted in FIG. 16, the firearm accessory 104 is a hand stop configured to be accepted by the panel 100 and firearm rail 128. The firearm accessory 104 may be a variety of different accessories configured to mount within the slot 114 of the panel 100. In some instances, the firearm accessory 104 may be a triangular shape configured to help a user grip the firearm rail 128. In other instances, the firearm accessory 104 may be a different shape, including cubical, pyramidal, spherical, cylindrical, or some other shape. The firearm accessory 104 may have a series of serrations, protrusions, or bumps to help improve grip along the surface of the firearm accessory 104. In other instances, the firearm accessory 104 may have a smooth surface.

Figure 17:
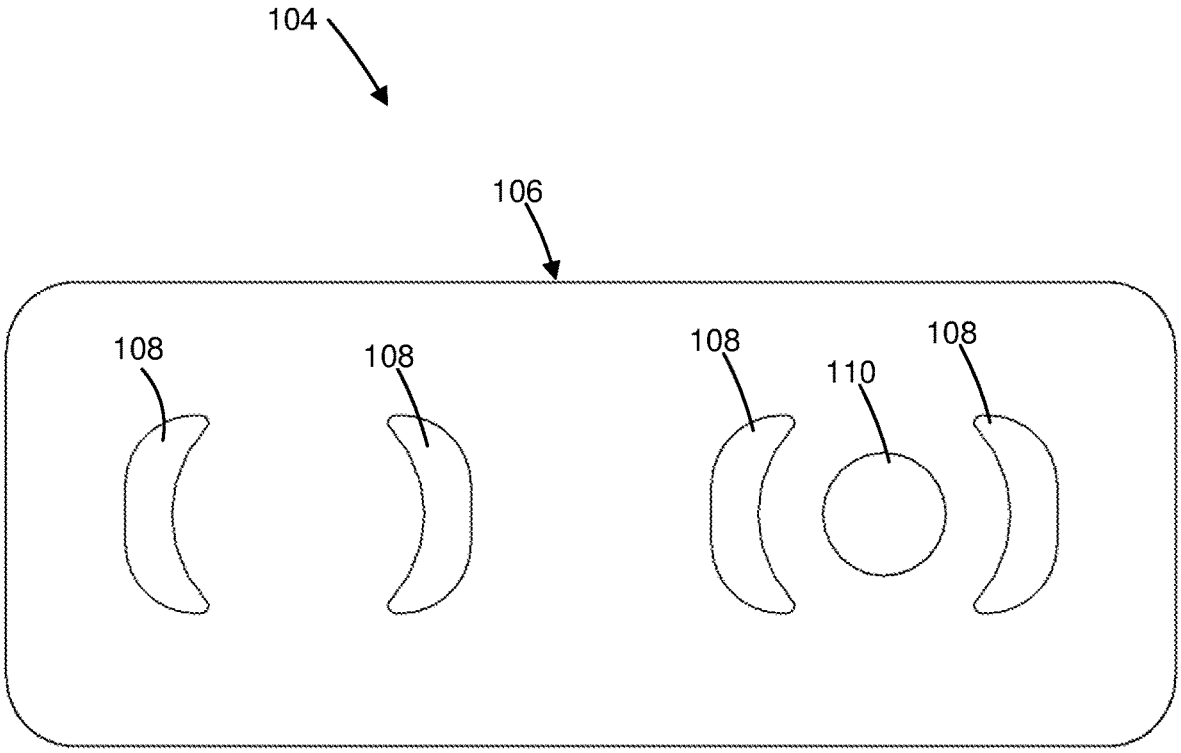
FIG. 17 is a top view of the hand stop according to one or more embodiments of the disclosure.

In some embodiments, as depicted in FIGS. 16 and 17, the firearm accessory 104 has a mounting surface 106 on one end of the firearm accessory 104 configured to be accepted by the panel 100 and firearm rail 128. In some instances, the firearm accessory 104 mounting surface 106 may be a different shape to be accepted by the panel 100. For example, the mounting surface 106 may be circular, square, triangular, or some other shape. In some embodiments, the firearm accessory 104 has a plurality of crescent protrusions 108 protruding from the mounting surface 106 for securing the firearm accessory 104 within the firearm rail 128 plurality of apertures 126. For example, the plurality of crescent protrusions 108 may be shaped to snuggly fit against the interior of the plurality of apertures 126. In other embodiments, the crescent protrusions 108 may not be crescent, but rather, another shape. For example, the crescent protrusions 108 may be rectangular, circular, triangular, or another shape.

Figure 18:
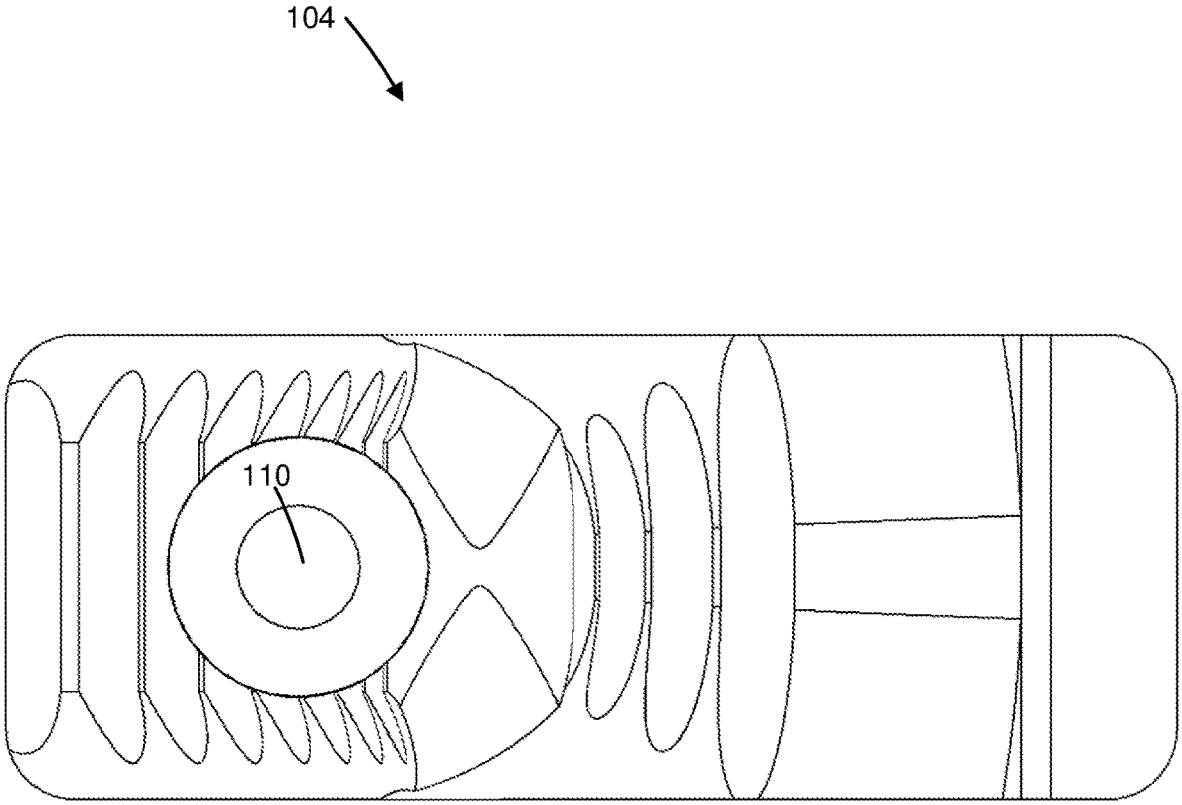
FIG. 18 is a bottom view of the hand stop according to one or more embodiments of the disclosure.

In some embodiments, as shown in FIGS. 17 and 18, the firearm accessory 104 includes an aperture 110. The aperture 110 may be configured to receive a fastener. For example, the aperture 110 and the fastener may selectively mount the firearm accessory 104 to the firearm rail 128. In some instances, the aperture 110 may extend from the mounting surface 106. In other instances, the aperture 110 may extend from another surface of the firearm accessory 104. The firearm accessory 104 may be composed of a metal alloy, a plastic, or some combination therein.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

What is claimed is:

1. A panel attachable to a firearm rail, the panel comprising:

an elongated body comprising a top side, an opposed bottom side, a front end, and a rear end, the front end and the rear end each comprising at least one aperture extending through the top side to the opposed bottom side of the elongated body, the at least one aperture is configured to receive a fastener;

a gripped surface on the top side of the elongated body; and a slot extending through the top side to the opposed bottom side configured to receive a firearm accessory.

2. The panel of claim 1, further comprising a series of protrusions extending from the opposed bottom side.

3. The panel of claim 1, further comprising a set of crescent protrusions about each at least one aperture on the opposed bottom side.

4. The panel of claim 1, wherein the slot defines a rounded-edge rectangular orifice.

5. The panel of claim 1, further comprising, a middle portion parallel with the slot and at least one aperture; and a set of side portions angled toward the opposed bottom side.

6. The panel of claim 5, wherein the middle portion defines a rectangular surface and the set of side portions define a trapezoidal surface.

7. The panel of claim 6, wherein the slot extends through the top side to the opposed bottom side on the middle portion.

8. The panel of claim 7, wherein the middle portion adjacent to the slot slopes toward the slot.

9. The panel of claim 6, wherein the middle portion adjacent to the at least one aperture slopes toward the at least one aperture.

10. The panel of claim 1, wherein the gripped surface comprises a series of cavities.

11. The panel of claim 10, wherein the series of cavities are semi-circular.

12. The panel of claim 1, wherein the gripped surface comprises a plurality of bores.

13. The panel of claim 12, wherein the plurality of bores are circular.

14. The panel of claim 1, wherein the top side slopes toward the opposed bottom side at the front end and the rear end of the elongated body.

15. The panel of claim 1, wherein the elongated body comprises a discontinuous channel adjacent to the at least one aperture.

16. A firearm rail assembly, comprising:

a firearm rail coupled to a firearm, the firearm rail comprising a plurality of apertures;

the elongated body of claim 1 selectively attached to the firearm rail at one of the plurality of apertures; and a firearm accessory coupled to the firearm rail, wherein the firearm accessory is positioned within the slot of the elongated body.

17. A firearm rail panel, comprising:

a elongated body, the elongated body comprising a discontinuous channel adjacent to at least one aperture;

a rectangular orifice extending through the elongated body;

a first aperture extending through the elongated body; and a second aperture extending through the elongated body.

18. The firearm rail panel of claim 17, wherein the elongated body comprises a top side, an opposed bottom side, a front end, and a rear end.

19. The firearm rail panel of claim 18, wherein the elongated body comprises a gripped surface on the top side of the elongated body.

20. A panel attachable to a firearm rail, the panel comprising:

an elongated body comprising a top side, an opposed bottom side, a front end, and a rear end, the front end and the rear end each comprising at least one aperture extending through the top side to the opposed bottom side of the elongated body, wherein the top side slopes toward the opposed bottom side at the front end and the rear end of the elongated body;

a gripped surface on the top side of the elongated body; and a slot extending through the top side to the opposed bottom side configured to receive a firearm accessory.

* * * * *